United States Patent [19]

Stoll et al.

[11] Patent Number: 4,738,124

[45] Date of Patent: Apr. 19, 1988

[54] YARN FEEDER SLIDE

[75] Inventors: Thomas Stoll, Reutlingen; Franz Schmid, Bodelshausen; Günther Kazmaier, St.Johann-Ohnastetten, all of Fed. Rep. of Germany

[73] Assignee: H. Stoll GmbH & Co., Reutlingen, Fed. Rep. of Germany

[21] Appl. No.: 68,882

[22] Filed: Jul. 1, 1987

[30] Foreign Application Priority Data

Jul. 1, 1986 [DE] Fed. Rep. of Germany ..... 3621964
May 20, 1987 [DE] Fed. Rep. of Germany ..... 3716931

[51] Int. Cl.[4] ..... D04B 15/52
[52] U.S. Cl. ..... 66/127
[58] Field of Search ..... 66/127, 128, 129, 130, 66/125

[56] References Cited

U.S. PATENT DOCUMENTS 4,052,865 10/1977 Zamarco ..... 66/127

FOREIGN PATENT DOCUMENTS 3536276 4/1987 Fed. Rep. of Germany ..... 66/125
2064599 6/1981 United Kingdom ..... 66/128

*Primary Examiner*—Ronald Feldbaum
*Attorney, Agent, or Firm*—Larson and Taylor

[57] ABSTRACT

The yarn feeder slide proposed for intarsia knitting on a flat knitting machine and provided with a braking device has brake shoes (22,23) projecting sideways on pivoted levers (16,31) and which extend into a special longitudinal slot of the associated yarn feeder rail and can be jammed therein. Two control regions (19,38) for the braking device or for a moveable yarn feeder arm are provided and are spaced from one another in the direction of displacement of the yarn feeder slide (10) so that the yarn feeder driving member located on the cam carriage of the flat knitting machine can be selectively lowered into both control regions (19,38) of the yarn feeder slide.

11 Claims, 4 Drawing Sheets

YARN FEEDER SLIDE

Figure 1:
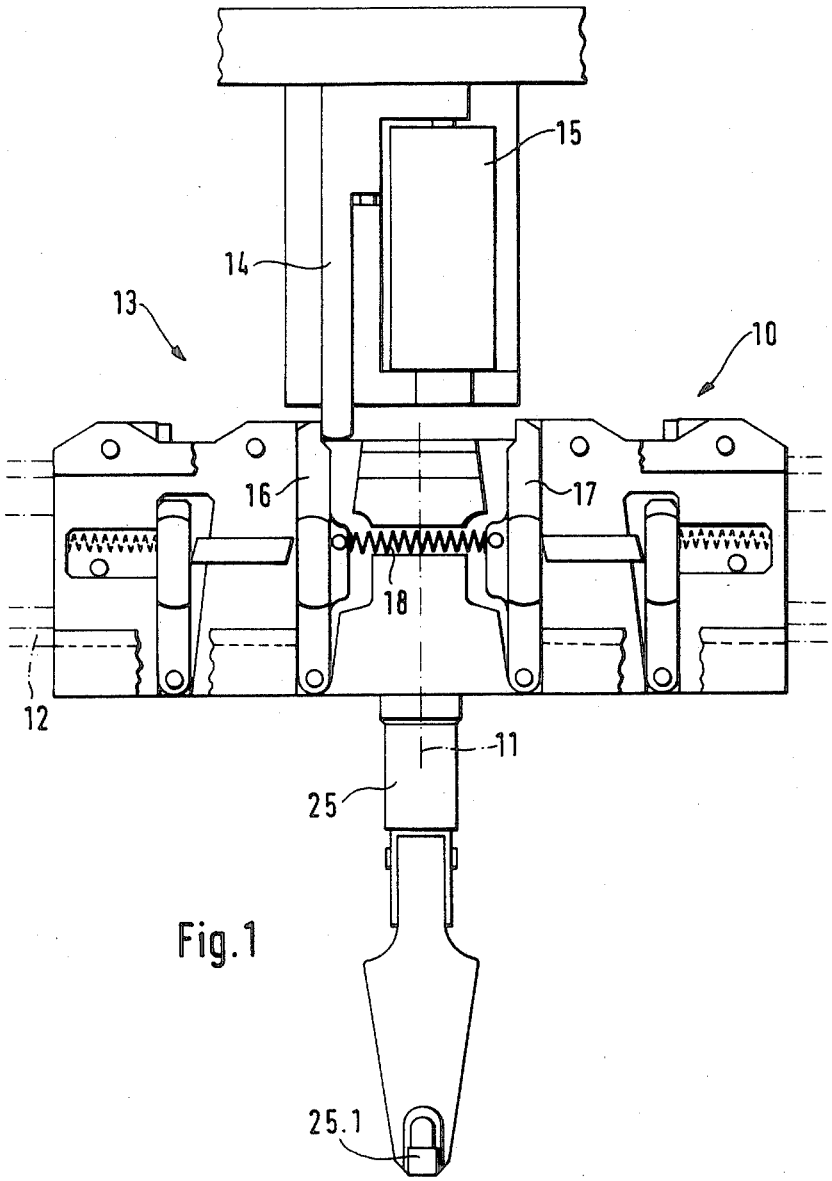

The invention relates to a yarn feeder slide for a flat knitting machine mounted for longitudinal movement on a yarn feeder rail, with dovetail guides, by a yarn feeder driving member movably located on the cam carriage of the flat knitting machine, and provided with a braking device, which has, for each of the two directions of sliding movement of the cam carriage, at least one spring-loaded pivoted lever provided with at least one locating shoe acting on the yarn feeder rail, and with a pivotable yarn feeder arm whose pivot position is determined by a slide member mounted in the yarn feeder slide and movable by the cam carriage in the direction of carriage movement.

A yarn feeder slide of the type set out in the introduction is intended especially for flat knitting machines on which intarsia knitting is to be produced. Yarn feeders with the characteristics set out in the introduction are known partly from DE-PS No. 30 45 758 and partly from their use. It must be ensured that the yarn feeder slides, after they have been freed by the moving cam carriages of the machines, are secured in the freed position and that the yarn feeder arm can be pivoted away from the transition position between two intarsia regions. It is a disadvantage of known yarn feeder slides proposed for the production of intarsia knitting that they require special driving members and control members on the cam carriage of the machine and the braking members act on the guide surfaces of the yarn feeder rails and effect them deleteriously.

The problem which is the basis of the invention is so to construct a yarn feeder slide of the type set out in the introduction that the disadvantages mentioned above are not present and thus no impairment of the guide surfaces of the yarn feeder rails results and, in addition, on changing over a flat knitting machine to intarsia knitting no adjustment of the cam carriage of the machine is necessary with respect to the control members for the yarn feeder slides.

The problem set out is solved according to the invention in a yarn feeder slide of the type set out in the introduction in that the securing brakes of the yarn feeder slide project into a special side slot of the yarn feeder rail and the yarn feeder driving member is, in known manner, a longitudinally movable, electromagnetically operated pin, which acts on the pivoted lever of the braking device and which can also influence the slide member for pivoting the yarn feeder arm of the yarn feeder slide.

In a yarn feeder slide constructed according to the invention, the guide surfaces, which are important for an exact adjustment movement of the yarn feeder, are not damaged by braking members acting on them. The special side slot on which the braking members of the braking device act can be provided on every yarn feeder rail as a precaution, irrespective of whether the flat knitting machine is equiped with yarn feeder slides for intarsia knitting or not. This longitudinal side slot can also be used, in addition, for guiding the yarn feeder slide.

Advantageously, the electromagnetically operable yarn feeder driving member can be arranged so that it can be selectively introduced into the control region of the pivoted lever as well as into the control region of the slide, which determines the pivot position of the yarn feeder arm, or only into the control region of the pivoted lever, and in each direction of adjustment of the yarn feeder slide, the control region of the slide is so far displaced with respect to the control region of the pivoted lever of the braking device, in dependence upon the speed of movement of the cam carriage, that the yarn feeder driving member has time, after retraction out of the control region of the pivoted lever, to fall away into the control region of the slide.

The yarn feeder slide can usefully have, for each direction of movement, two pivoted levers carrying brake shoes, one of which is engaged by the yarn feeder driving members and between which is located a free slide as a coupling member, so that the coupling member lies against one side of the pivoted lever not contacted by the yarn feeder driving member and a pressure spring, which effects a bias in the braking direction, acts on the other side. The two brake shoes make more certain the achievement in intarsia knitting of the important, immediate halting of the yarn feeder slide after it has been freed by the yarn feeder driving member. The unimpeded braking effect of both brake shoes can be safeguarded in that the contact position of the free slide is spaced a greater distance from the pivot axis of one of the two brake shoes than from the pivot axis of the other of the two brake shoes. This results in different pivotal movements of the two brake shoes for the same pivot angle and it is ensured that the coupling member does not hinder the braking action of either of the two brake shoes. Advantageously, there can be located between each brake shoe and the associated contact surfaces of the longitudinal slot of the yarn feeder slide a smooth, small, brake pad of abrasion-resistant material, which increases the braking surface effective on the yarn feeder rail. The small brake pads can be formed as interchangeable pads and can be simply mounted by being pushed onto the associated pivoted lever for which purpose they are provided with an aperture into which the pivoted lever fits.

Further features which result in an advantageous extension of the subject matter of the invention in the sense of the problem presented are set out in the subordinate claims.

An embodiment of a yarn feeder slide constructed according to the invention is described below in greater detail in connection with the accompanying drawings.

Figure 2:
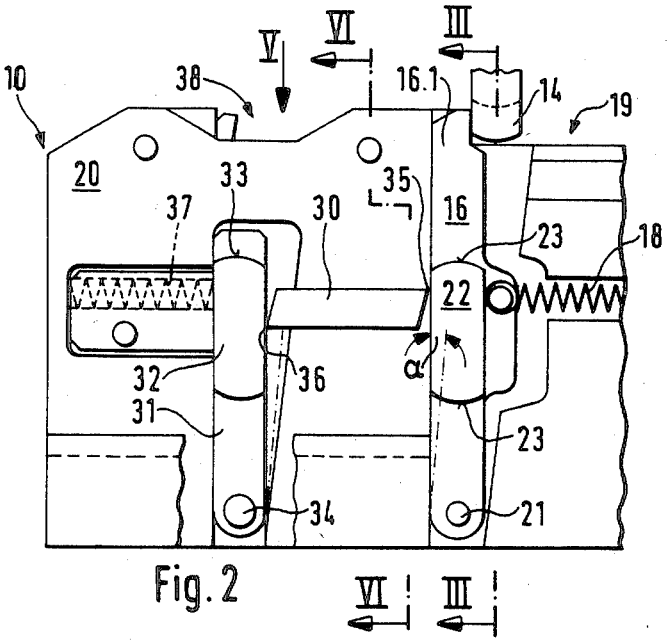
Figure 3:
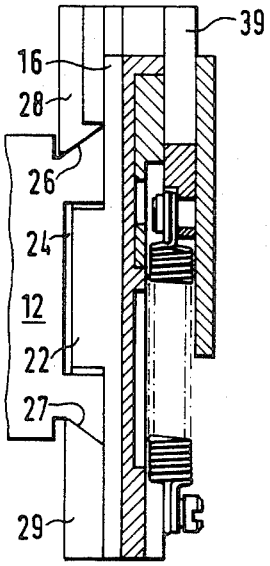
Figure 6:
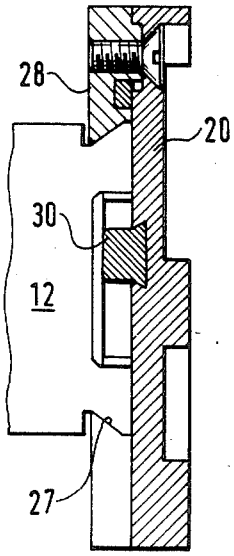
Figure 4:
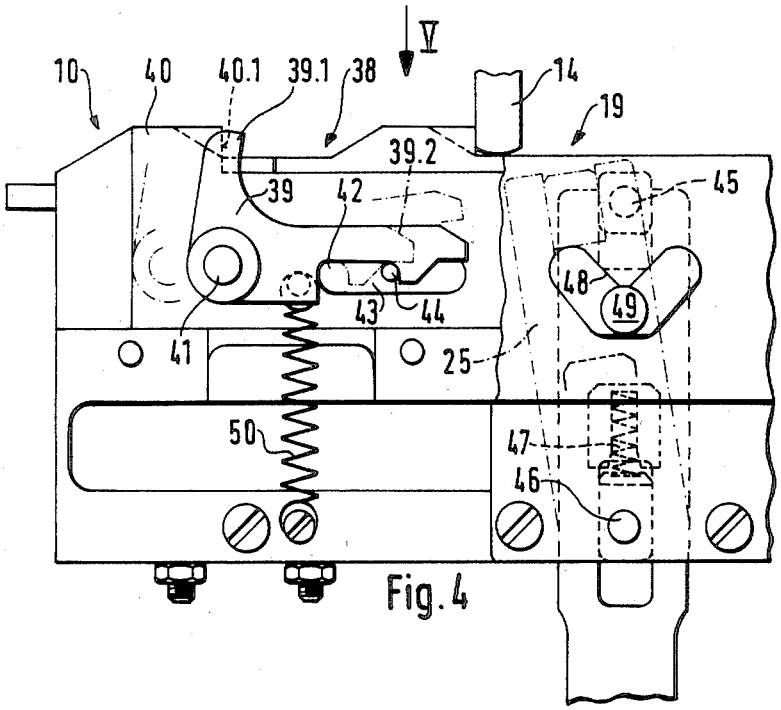
Figure 5:
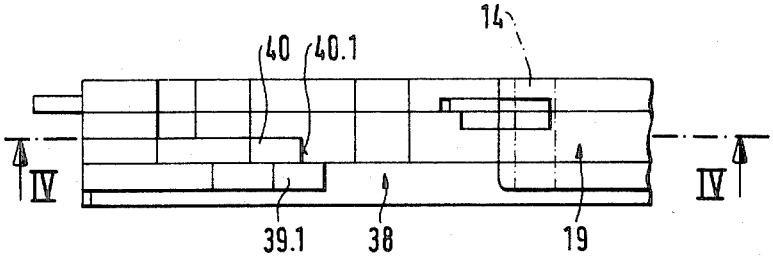
Figure 8:
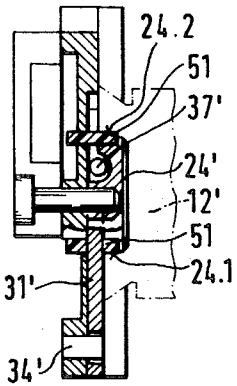
Figure 7:
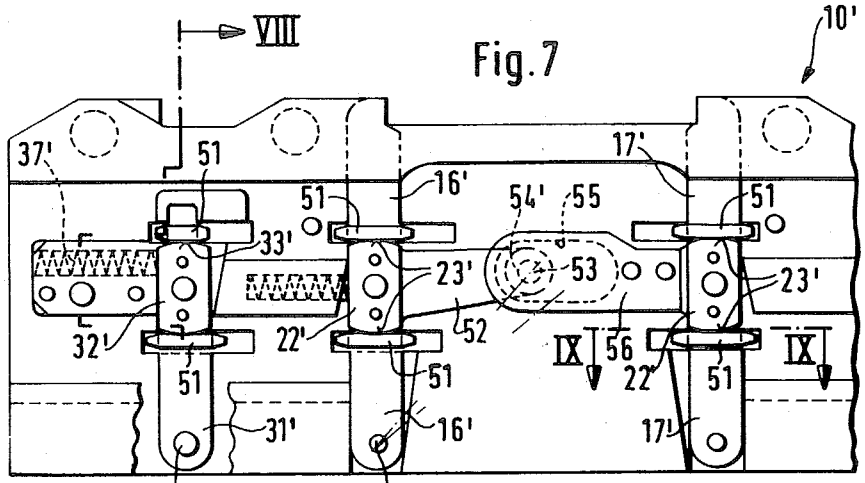
Figure 9:
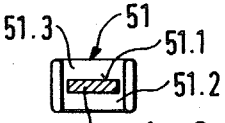

In detail, these show:

FIG. 1 a general view of a yarn feeder slide together with a yarn feeder arm and a yarn feeder rail;

FIG. 2 a view, on an enlarged scale compared with FIG. 1, of half the side of the yarn feeder slide adjacent the rail, the yarn feeder slide being formed in a mirror-image symmetrical fashion;

FIG. 3 a cross-section through the yarn feeder along the line III—III in FIG. 2;

FIG. 4 a longitudinal section through the half of the yarn feeder slide along the line IV—IV in FIG. 5;

FIG. 5 a plan view on the upper driving side of the half of the yarn feeder slide in the direction of the arrow V in FIGS. 2 and 4;

FIG. 6 a cross-section through the yarn feeder slide along the line VI—VI in FIG. 2;

FIG. 7 a partial view corresponding approximately to FIG. 2 of the side of a modified form of the yarn feeder slide adjacent to the rail;

FIG. 8 a cross-section through the yarn feeder slide according to FIG. 7 along the line VIII—VIII in FIG. 7;

FIG. 9 a cross-section through a pivoted lever of the yarn feeder slide according to FIG. 7 along the line IX—IX in FIG. 7.

FIG. 1 shows schematically, and from the side adjacent the yarn feeder rail, a yarn feeder slide 10, which is formed with mirror image symmetry about its central cross-sectional plane indicated by a chain-dotted line 11, and which is mounted on a yarn feeder rail 12, indicated by chain-dotted lines, so as to be moveable longitudinally in both directions and also securable on the rail. Shifting movement of the yarn feeder slide in one or other direction in brought about by a pin-like yarn feeder driving member 14 mounted on a cam carriage 13 of the flat knitting machine, which is only indicated in the drawing, and which can be brought into and out of engagement with control regions of the yarn feeder slide 10 by means of an electromagnet 15. Two pivoted levers 16 and 17 of a braking device of the yarn feeder slide 10 are shown in FIG. 1 and are arranged in mirror-image fashion about the plane of symmetry 11 and connected with one another by a tension spring 18.

FIG. 2 shows on a larger scale and in greater detail the left half of the yarn feeder slide 10 shown schematically in FIG. 1. The pivoted lever 16, whose upper end 16.1 is contacted by the pin-like yarn feeder driving member 14, which projects into the control region 19 for the braking device formed by an upper indentation in a central supporting plate 20 of the yarn feeder slide, is pivotable by its lower end about a stud 21 secured in the supporting plate 20 and carries in its middle region a brake shoe 22 with rounded brake surfaces 23 and which projects out of the plane of the drawing. The brake shoe 22 extends into a longitudinal side slot 24 of a yarn feeder rail 12 which can be seen in the cross-section of FIG. 3. The yarn feeder rail 12 is provided on both longitudinal sides with a longitudinal slot 24 and with an upper inclined guide surface 26 and a lower inclined guide surface 27 on which the yarn feeder slide 10 slides in the manner of a dovetail guide with guide members 28 and 29 secured on the base plate 20.

As can be seen in FIG. 2, the pivoted lever 16 is coupled with a second shorter pivoted lever 31 by a free slide 30 and the lever 31 is also provided with a brake shoe 32 with rounded brake surfaces 33 which projects out of the plane of the drawing. The pivoted lever 31 is pivotable about a stud 34. The free slide 30 which serves as coupling member is obliquely shaped at its ends so that it rests against the pivoted lever 16 at an upper position 35 and against the other pivoted lever 31 at a lower position 36. The position 35 is spaced a greater distance from the pivot of the pivoted lever 16 formed by the stud 21 than the position 36 from the pivot of the pivoted lever 31 formed by the stud 34. Thus, for the same pivot angle, a greater movement of the pivoted lever 16 results in the region of the contact position 35 of the slide 30 than the movement of the other pivoted lever 31 at the contact position 36. In this way, on movement of the two pivoted levers 16 and 31 into the braking position, in which the brake shoes 22 and 32 are wedged tightly in the longitudinal slot 24 of the yarn feeder slide 12, the slide 30 is freed at its ends so that it does not impede the brake shoes in their braking position. The two pivoted levers are brought into the braking position by a pressure spring 37 acting on the pivoted lever 31, or by a tension spring 18, as soon as yarn feeder driving member 14 is withdrawn from the control region 19 of the yarn feeder slide 10 and the upper end 16.1 of the pivoted lever 16 is freed.

FIG. 4 shows the elements for locking and pivoting the yarn feeder arm 25 which is provided with a yarn guide 25.1 (FIG. 1) at its end. Each half of the yarn feeder slide 10 is provided with a special control region 38 on its upper side, which is spaced sufficiently far in the direction of displacement of the yarn feeder slide 10 from the control region 19 for the braking device, so that the yarn feeder driving member 14 has time, if required after being lifted out of the control region 19 to be immediately lowered into the following control region 38 for the yarn feeder arm 25. The control region 38 is bounded by an arm 39.1 of a two-arm catch 39 which is pivotable against the action of a tension spring 50 about a stud 41 fixed on a slide 40. The slide 40 also has an abutment edge 40.1 for the yarn feeder driving member 14, which limits the control region 38, but this edge 40.1 is displaced with respect to the arm 39.1 of the catch so that the yarn feeder driving member 14 entering the control region 38 meets first the arm 39.1 of the catch so that the second arm 39.2 of the catch 39, which is provided with detent openings 42 and 43, is brought out of contact with a retaining pin 44 secured on the plate 20 of the yarn feeder slide 10 before the yarn feeder driving member 14 comes up against the edge 40.1 of the slide 40. The slide 40 is coupled with the yarn feeder arm 25 by a pin 45, which is mounted in the yarn feeder slide 10 so as to be pivotable about an axis 46 and is also longitudinally moveable against the action of a return spring 47, so that the yarn feeder guide 25.1 (FIG. 1) is shifted as well as pivoted out of its operative region. The shifting movement of the yarn feeder arm is determined by a V-shaped link 48, into which extends a roller 49 of the yarn feeder arm 25.

In the embodiment shown, not only is the pick-up of the yarn feeder slide 10, which is constructed for intarsia knitting, effected by a yarn feeder driving member 14 located on the cam carriage, but also the movement of the yarn feeder arm 25. Within the intarsia knitting program, only the control of the electromagnet 15 is adjusted and effected so that the yarn feeder driving member 14 after being lifted out of the contact region 19 of the yarn feeder slide 10 is lowered again into the following contact region 38, but only if in fact an adjustment of the yarn feeder arm 25 is desired. If such an adjustment is not necessary, for example at the outer edge of the intarsia knitting, the yarn feeder driving member 14 is retained by the electromagnet, so that it is not lowered into the following control region 38 and thus does not influence the yarn feeder arm 25. In this way, unnecessary movements of the yarn feeder and also unnecessary noise are avoided.

FIGS. 7 to 9 show a modified embodiment of a yarn feeder slide 10′ in which the same parts are indicated by the same reference numerals as in FIGS. 1 to 6 supplemented with an index mark. This embodiment differs from the yarn feeder slide 10 of FIGS. 1 to 6 by the location of small, smooth brake pads 51 between the braking surfaces 23′ or 33′ of the brake shoes 22′ and 32′ of the pivoted levers 16′, 17′ and 31′ and the associated contact surfaces 24.1, 24.2 of the longitudinal side slot 24′ of the yarn feeder rail 12′ which can be seen in FIG. 8. According to the cross-section of FIG. 9, the brake pads 51 are symmetrically formed and are provided with a central longitudinal aperture 51.1 by means of which they can be pushed as a close fit onto the pivoted lever 16′, 17′ or 31′ so that they project at one side between the brake shoes 22′ or 32′. The brake pads, which are made from an abrasion-resistant material, can, because of their symmetrical construction, be used as interchangeable pads and can selectively extend between the brake shoes and the contact surfaces 24.1, 24.2 of the longitudinal slot 24' with the region 51.2 or the other region 51.3 shown in FIG. 9.

In the yarn feeder slide 10' according to FIGS. 7 to 9, a positive coupling is also provided between the two pivoted levers 16' and 17', which ensures that in each case the pivoted lever 16' or 17' struck by the yarn feeder driving member 14 (FIG. 1) moves the other pivoted lever 17' or 16', which has not been struck, to a definite position. To this end, there is secured to the pivoted lever 16' a lever 52 at the end of which a coupling roller 54 is mounted on a sideways projecting coupling pin 53. The coupling roller 54 extends into a longitudinal aperture 55 in a lever 56, which is connected to the other pivoted lever 17'. If, for example, the pivoted lever 16' is struck and is moved to the left out of the rest position shown in FIG. 7, the coupling roller 54 comes in contact with the end of the longitudinal apperture 55 and moves the lever 56 and thus the other pivoted lever 17' to the left, so that the pivoted lever 17' comes into a position in which its brake shoe 22' is in a definite free position and cannot exert any braking effect.

We claim:

1. A yarn feeder slide for a flat knitting machine for intarsia knitting mounted for longitudinal movement on a yarn feeder rail, with dovetail guides, by a yarn feeder driving member located on a cam carriage of the flat knitting machine, and provided with a braking device, which has, for each of two directions of sliding movement of the cam carriage, at least one spring-loaded pivoted lever provided with at least one brake shoe acting on the yarn feeder rail, and with a moveable yarn feeder arm whose position is determined by a slide member mounted in the yarn feeder slide and movable by the cam carriage in the direction of carriage movement, characterized in that the brake shoe (22, 32) of the yarn feeder slide (10) project into a special longitudinal side slot (24) of the yarn feeder rail (12) and the yarn feeder driving member (14) is a longitudinally moveable, electromagnetically operable pin, which strikes the pivoted lever (16, 17) of the braking device and which can also act on the slide which determines the position of the yarn feeder arm (25).

2. A yarn feeder slide according to claim 1, characterised in that the electromagnetically operable yarn feeder driving member (14) can be selectively introduced into a control region (19) of the pivoted lever (16, 17) of the braking device as well as into a control region (38) of the slide (40) which determines the position of the yarn feeder arm (25), and in each direction of movement of the yarn feeder slide (10), the control region (38) of the slide (40) is so far displaced with respect to the control region (19) of the pivoted lever (16) of the braking device, in dependence upon the speed of movement of the cam carriage, that the yarn feeder driving member (14) can, after withdrawal from the control region (19) of the pivoted lever (16), fall into the control region (38) of the slide (40).

3. A yarn feeder slide according to claim 2, characterised in that the brake shoes (22, 32) are located in a central region of the pivoted lever (16, 17, 31) and project sideways.

4. A yarn feeder slide according to claim 1, characterised in that for each direction of movement of the yarn feeder slide (10) two pivoted levers (16, 17) carrying brake shoes (22, 32) are provided, one (16) of which is engaged by the yarn feeder driving member (14) and between which is located a free slide (30) as a coupling member, and in that the coupling member lies against one side of a pivoted lever (31) not contacted by the yarn feeder driving member (14) and a pressure spring (37), which effects a bias in the braking direction, acts on the other side.

5. A yarn feeder slide according to claim 4, characterised in that the contact position (35) of the free slide (30) on one of the two pivoted levers (16) is spaced a greater distance from its pivot axis (21) than the contact position (36) of the free slide (30) on the other of the pivoted levers (31) is spaced from its pivot axis (34).

6. A yarn feeder slide according to claim 1, characterised in that the two pivoted levers (16, 17) of the braking device are provided for different directions of movement and are connected to one another by a tension spring (18).

7. A yarn feeder slide according to claim 1, characterised in that the two pivoted levers (16', 17') are provided for different directions of movement and are positively connected to one another by levers (52, 56) such that in each case the pivoted lever (16', 17') struck by the yarn feeder driving member (14) moves the other pivoted lever (17', 16'), which has not been struck, with it to a free position.

8. A yarn feeder slide according to claim 7, characterised in that a lever fixed to one pivoted lever (16') carries a sideways projecting coupling pin (53) with a coupling roller (54) which engages in a coupling slot (55) of a parallel lever (56) connected with the other pivoted lever (17').

9. A yarn feeder slide according to claim 1, characterised in that a smooth, small brake pad (51) is located between the brake shoes (22', 32') and the associated contact surfaces (24.1, 24.2) of the longitudinal slot (24') of the yarn feeder rail (12').

10. A yarn feeder slide according to claim 9, characterised in that the brake pads (51) are mounted as interchangeable pads by being pushed into the associated pivoted lever (16',17',31') which enters an aperture in the pad.

11. A yarn feeder slide according to claim 1, characterised in that the electromagnetically operable yarn feeder driving member (14) can be selectively introduced only into a control region (19) of the pivoted lever (16, 17) of the braking device, and in each direction of movement of the yarn feeder slide (10), the control region (38) of the slide (40) is so far displaced with respect to the control region (19) of the pivoted lever (16) of the braking device, in dependence upon the speed of movement of the cam carriage, that the yarn feeder driving member (14) can, after withdrawal from the control region (19) of the pivoted lever (16), fall into the control region (38) of the slide (40).

* * * * *